US010180278B2

(12) United States Patent
Lux et al.

(10) Patent No.: US 10,180,278 B2
(45) Date of Patent: Jan. 15, 2019

(54) DOMESTIC REFRIGERATION APPLIANCE HAVING A FOOD-ACCOMMODATING CONTAINER WITH SPECIFICALLY APPLIED DECORATIVE FILM

(71) Applicant: BSH HAUSGERAETE GMBH, Munich (DE)

(72) Inventors: Denis Lux, Heidenheim (DE); Stefan Deissler, Noerdlingen (DE); Bernd Pfister, Ulm (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/551,608

(22) PCT Filed: Jan. 26, 2016

(86) PCT No.: PCT/EP2016/051535

§ 371 (c)(1),
(2) Date: Aug. 17, 2017

(87) PCT Pub. No.: WO2016/131610

PCT Pub. Date: Aug. 25, 2016

(65) Prior Publication Data

US 2018/0023879 A1 Jan. 25, 2018

(30) Foreign Application Priority Data

Feb. 18, 2015 (DE) ..... 10 2015 202 889

(51) Int. Cl.
*F25D 23/04* (2006.01)
*F25D 25/02* (2006.01)

(52) U.S. Cl.
CPC ..... *F25D 23/04* (2013.01); *F25D 25/021* (2013.01); *F25D 25/025* (2013.01); *F25D 2400/18* (2013.01)

(58) Field of Classification Search
CPC ..... F25D 23/04; F25D 25/021; F25D 25/025; F25D 2400/18
See application file for complete search history.

(56) References Cited

U.S. PATENT DOCUMENTS

2005/0017605 A1* 1/2005 Bauer ..... B32B 15/08 312/204
2009/0039749 A1* 2/2009 Gerstner ..... F25D 23/04 312/404

(Continued)

FOREIGN PATENT DOCUMENTS

DE 69801718 T2 7/2002
DE 10208065 A1 9/2003

(Continued)

*Primary Examiner* — Hanh V Tran
(74) *Attorney, Agent, or Firm* — Laurence A. Greenberg; Werner H. Stemer

(57) ABSTRACT

A tray-shaped food-accommodating container for a domestic refrigeration appliance includes a lateral wall with a first planar wall and at least a second planar wall disposed at an angle to each other. The first and second planar walls open out at a curved transition of the lateral wall interconnecting the first and second planar walls. A decorative film, which is provided in areas of the lateral wall, is formed in one piece across the transition and areas of the first and second planar walls. A lower edge of the decorative film, which faces away from an upper edge of the container, is disposed along a stepless surface-area of the transition, along a stepless surface-area of the first planar wall and along a stepless surface-area of the second planar wall. A domestic refrigeration appliance having the container is also provided.

7 Claims, 2 Drawing Sheets

(56) References Cited

U.S. PATENT DOCUMENTS

| | | | | |
|---|---|---|---|---|
| 2009/0089942 | A1* | 4/2009 | Pyles | C08J 7/065 8/515 |
| 2011/0316405 | A1* | 12/2011 | Fink | F25D 23/04 312/405.1 |
| 2013/0099650 | A1* | 4/2013 | Lee | F25D 23/028 312/404 |

FOREIGN PATENT DOCUMENTS

| | | | |
|---|---|---|---|
| DE | 102004012497 | A1 | 10/2005 |
| DE | 20321662 | U1 | 10/2008 |
| DE | 102009028784 | A1 | 2/2011 |
| DE | 102012221800 | A1 | 5/2014 |
| DE | 102013100456 | A1 | 7/2014 |

* cited by examiner

DOMESTIC REFRIGERATION APPLIANCE HAVING A FOOD-ACCOMMODATING CONTAINER WITH SPECIFICALLY APPLIED DECORATIVE FILM

BACKGROUND OF THE INVENTION

Field of the Invention

The invention relates to a food-accommodating container for a domestic refrigeration appliance, which is embodied in the form of a tray and a lateral wall with a first planar wall and a second planar wall arranged at an angle thereto. The walls open out at a curved transition which connects the walls and is an integral part of the lateral wall. Furthermore, the food-accommodating container has a decorative film, which is applied to areas of the lateral wall. Moreover the invention relates to a domestic refrigeration appliance having at least one such food-accommodating container.

It is known that domestic refrigeration appliances for storing and conserving food, such as for instance a refrigerator or freezer or a refrigerator-freezer combination device have food-accommodating containers in the form of door trays or drawers. These food-accommodating containers are typically embodied from plastic and are transparent. By means of these decorative films, individual optical embodiments can be achieved and appliance variants can be easily embodied. Since no explicit metallic parts have to be used for instance to display a metallic, in areas, food-accommodating container, a corresponding decorative film can instead be optically designed in this regard.

Decorative films of this type can however either only be applied to one wall and can therefore be attached locally only to a limited degree. The application is difficult specifically when, in respect of the height of the tray-type food-accommodating container, a decorative film of this type is only to be applied in areas and is thus not to be applied across the complete height, so that a uniform appearance may, if applicable, only be embodied in a careless and non-uniform manner specifically on a lower edge of the decorative film.

SUMMARY OF THE INVENTION

The object of the present invention is to create a food-accommodating container for a domestic refrigeration appliance and a domestic refrigeration appliance of this type, in which the decorative film can be embodied on the lateral wall as and when required.

This object is achieved by a food-accommodating container and a domestic refrigeration appliance according to the independent claims.

An inventive food-accommodating container for a domestic refrigeration appliance is embodied in the form of a tray. The food-accommodating container thus comprises a lateral wall, which has a first planar wall and at least one second planar wall. The two walls are arranged at an angle between 85° and 95° in relation to one another. At the ends of these two walls that face one another they each open out at a curved transition which connects the walls and is likewise an integral part of the lateral wall. The food-accommodating container furthermore comprises a decorative film which is only embodied on areas of the lateral wall. One essential idea behind the invention is that the decorative film is provided in one piece and attached to the lateral wall. This one-piece decorative film is embodied both on the transition and also in areas on the first wall and in areas on the second wall. The decorative film thus covers an exterior of the lateral wall both in the transition and also on the two walls adjacent thereto. Furthermore, it is essential that a lower edge of the decorative film that faces away from an upper edge of the food-accommodating container is arranged on a stepless surface area of the transition and on a stepless surface area of the first wall and on a stepless surface area of the second wall. This means that the decorative film ends with its lower edge on a stepless surface area. Therefore this lower edge does not end directly on a horizontal step formed in the walls and the transition since a step of this type is not present here in the walls and the transition. Embodiments of the walls and of the transition are thus embodied, in which those surface areas of the transition and the two walls which are covered by the decorative film pass steplessly into the surface areas not covered directly by the decorative film and adjoining the lower edge of the decorative film, when viewed in respect of the height direction of the food-accommodating container. Therefore there is in effect a level or flush transition between the surface areas of the walls covered by the decorative film and the transition to those surface areas of the walls and the transition which are embodied to adjoin the lower edge of the decorative film and are not covered. The decorative film is therefore embodied as a single continuous element across various surfaces of the lateral wall which do not extend in a shared plane and furthermore the lower edge of the decorative film runs to a point at which there is no step in the walls and transition of the lateral wall.

Aside from an also optically very sharp and precise lower boundary of the decorative film, no optically unwanted shadow effects are thus also generated.

Provision is preferably made for the lower edge of the decorative film to be arranged so as to run horizontally.

In particular, provision is made for the decorative film to be embodied as a horizontal strip.

It is advantageous if the decorative film is a hot stamping film. This means that the film is applied to the exterior of the food-accommodating container by means of a hot stamping procedure. As a result, a very positionally accurate and bubble-free application of the film can be generated, which to this effect then also remains durably on the lateral wall without individually becoming detached. This is important particularly with the different influencing parameters, in particular significantly fluctuating temperatures, to which the food-accommodating container is exposed, since it may be arranged in the domestic refrigeration appliance and exposed to cold temperatures and on the other hand however can also be exposed to significantly higher temperatures when removing the food-accommodating container out of the domestic refrigeration appliance and for instance for removing food or even for cleaning in the sink and hot water.

A roller embossing can preferably be provided here.

The decorative film is preferably embodied to be opaque. As a result, inspection of the food-accommodating container from the outside can be obstructed at very individual points on the lateral wall. This can also be embodied in areas.

Provision can be made for the decorative film to have a brushed, metallic appearance. As a result, a food-accommodating container which appears to be embodied at least in areas from a metallic material is created by a simple, thin and flexible film. A very cost-effective individual embodiment of the food-accommodating container which is partially provided from metallic materials can be achieved as a result by a decorative film which appears to be specifically optical in this way.

The decorative film may be a plastic film which is printed with a corresponding theme. The decorative film may also have a metallic coating as an outer layer.

Provision is preferably made for the decorative film to be embodied as a strip in the peripheral direction about the lateral wall and thus in the peripheral direction about a height direction of the food-accommodating container, said strip extending completely across the length of the transition measured in the peripheral direction and the length of the first wall measured in the peripheral direction and the length of the second wall measured in the peripheral direction. As a result, an uninterruptible strip is formed by the decorative film.

The decorative film preferably opens out at the upper edge of the food-accommodating container with an upper edge, which, viewed in the height direction of the food-accommodating container, faces the lower edge. As a result, the decorative film is embodied in effect so as to trail upward and thus in effect also represents an upper strip of the food-accommodating container.

By means of the decorative film, a type of dirt screen can thus also be created clearly individually. An individual coloring and/or theme in this area, in which the decorative film is attached, also prevents the immediate recognition of fingerprints or other smudges on the lateral walls, which may also occur for instance on account of the stored food. As a result, a cleaner and more hygienic impression of the food-accommodating container is imparted by means of this decorative film.

The food-accommodating container is in particular a door tray, which is arranged on an interior of the door, which is embodied to close an interior or a receiving space of the domestic refrigeration appliance. The food-accommodating container may however also be a drawer, which can be pushed into and pulled out of the receiving space.

Furthermore, the invention also relates to a domestic refrigeration appliance having at least one such food-accommodating container.

The indications "top", "bottom", "front", "rear", "horizontal", "vertical", "lateral", "depth direction", "width direction", "height direction" indicate the positions and orientations existing in the case of normal use and normal arrangement of the food-accommodating container and of the domestic refrigeration appliance and in the case of an observer standing in front of the food-accommodating container and the domestic refrigeration appliance and looking in the direction of the food-accommodating container and the domestic refrigeration appliance.

Further features of the invention will emerge from the claims, the figures and the description of the figures. All features and combinations of features mentioned above in the description and the features and combinations of features mentioned below in the description of the drawings and/or merely shown in the drawings may be used not only in the combination indicated in each case but also in other combinations or alone, without going beyond the scope of the invention. Embodiments of the invention that are not specifically illustrated and explained in the figures but which emerge and can be generated as a result of separate feature combinations from the described embodiments should therefore also be considered to be comprised and disclosed. Explanations and combinations of features which therefore do not have all features of an originally formulated independent claim are also to be regarded as disclosed.

BRIEF DESCRIPTION OF THE SEVERAL VIEWS OF THE DRAWING

Exemplary embodiments of the invention are explained in greater detail below on the basis of schematic drawings, in which.

DESCRIPTION OF THE INVENTION

Figure 1:
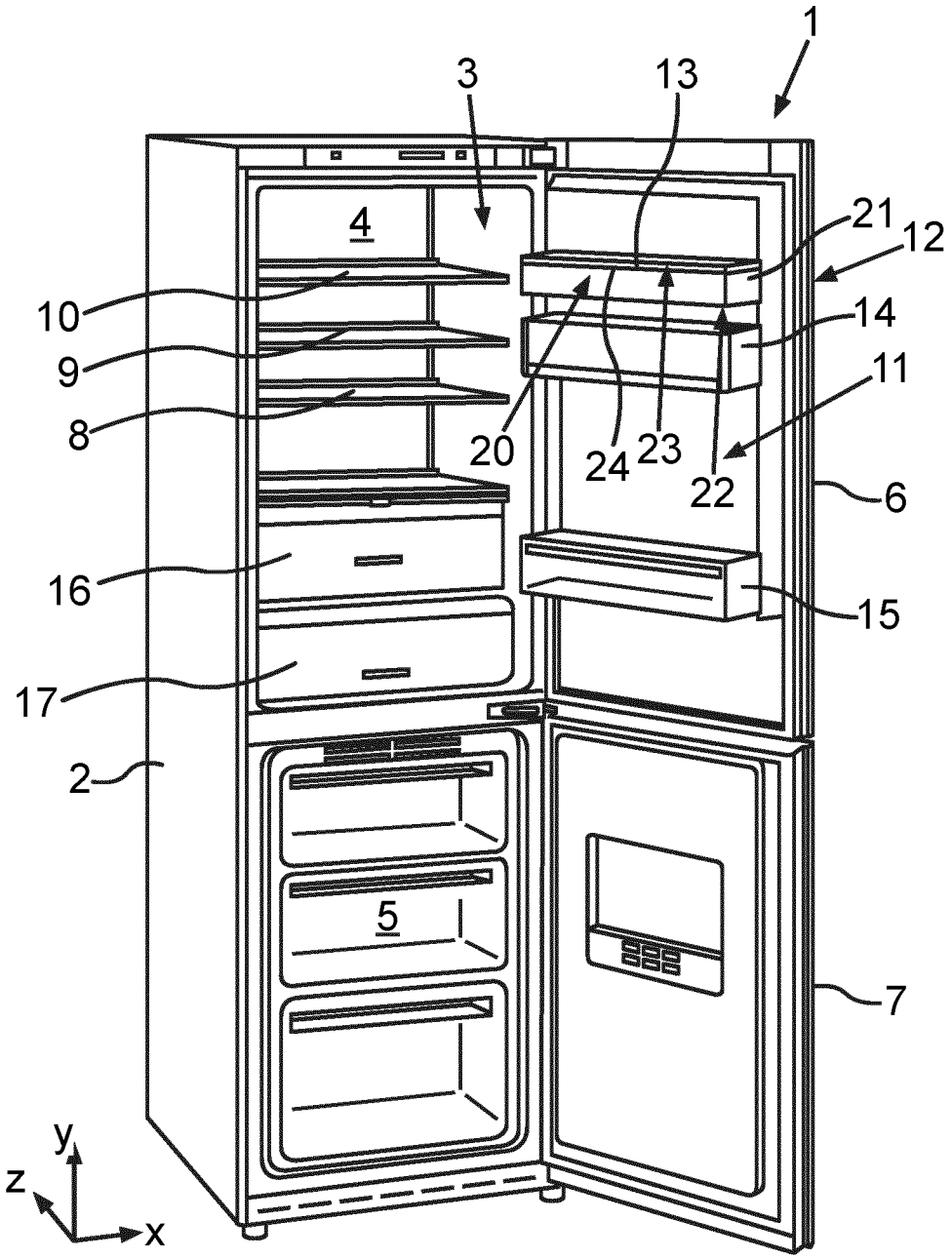
FIG. 1 shows a perspective view of an exemplary embodiment of an inventive domestic appliance as a domestic refrigeration appliance.

In the figures, identical or functionally similar elements are provided with the same reference characters.

FIG. 1 shows an exemplary view of a domestic refrigeration appliance 1 which can be a refrigerator or a freezer or a refrigerator-freezer combination device, and which is designed to store and conserve food. This domestic refrigeration appliance 1 comprises a housing or a body 2 with an inner container 3. With its walls the inner container 3 delimits a first interior or receiving space 4, which is a refrigerating zone and a second interior or receiving space 5 for food arranged therebelow and separated therefrom, which is a freezer compartment. The first receiving space 4 serves generally for frost-free cooling of refrigerated goods, preferably at temperatures between +4° C. and +8° C. The first receiving space 4 can however also be embodied as a 0° C. compartment, particularly for keeping fruit or vegetables fresh. The first receiving space 4 is accessible when a door 6 which closes this receiving space 4 from the front is opened. The second receiving space 5 serves generally to deep freeze frozen foods, at −18° C. for instance. The second receiving space 5 is accessible when the further second door 7 is opened.

As apparent from the view in FIG. 1, compartment dividers 8, 9 and 10 are arranged in the receiving space 4 in terms of number and in respect of the height position (y-direction). As is also apparent, the door 6 has an interior 11, which, when the door 6 is in the closed state, is facing the receiving space 4. In this context this interior 11 is then also a boundary wall of a door element 12, which is embodied in the form of a plate or a wall.

Furthermore, door trays 13, 14 and 15 are to be understood as arranged in the manner of food-accommodating containers in the schematic view in FIG. 1, also in turn in respect of the number, the embodiment and the individual height direction measured in the y-direction. Furthermore, drawers 16 and 17 arranged in the receiving space 4 and which can be pushed into and pulled out thereof can also be a further type of food-accommodating containers.

Figure 2:
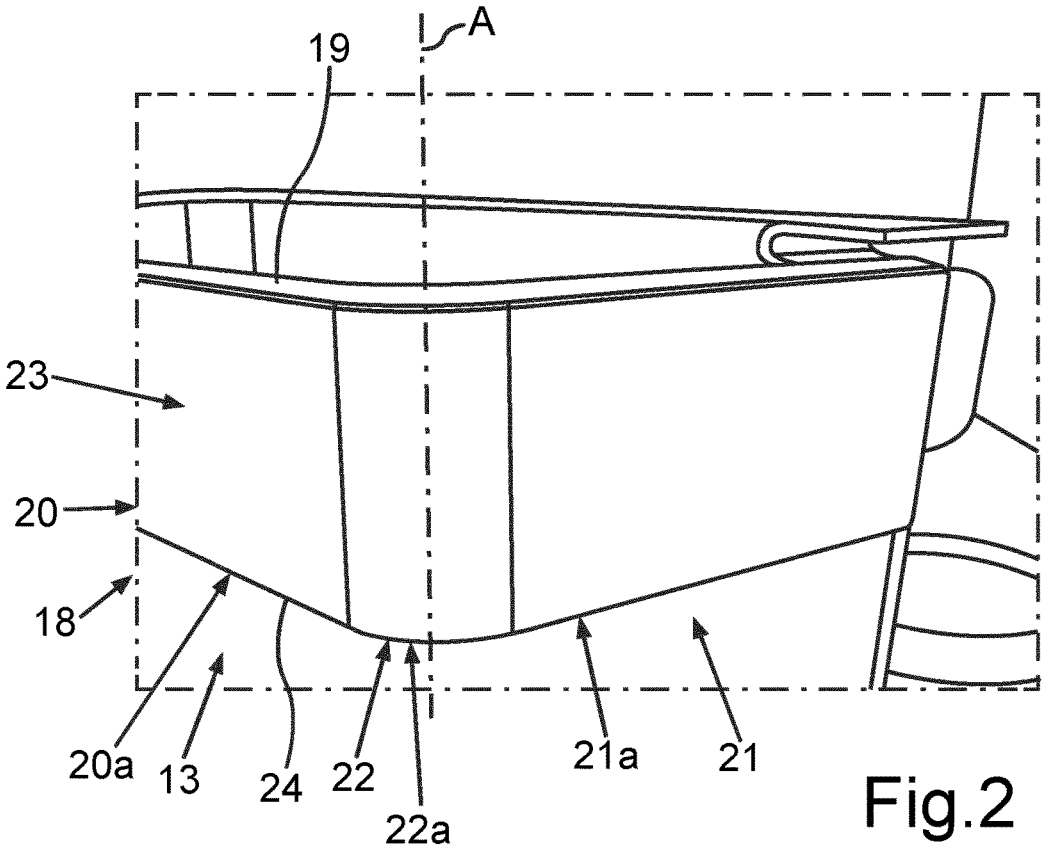
FIG. 2 shows a perspective view of an exemplary embodiment of an inventive food-accommodating container.

The said food-accommodating containers are overall embodied in the form of trays. For further explanation a partial cutout of the door tray 13 is shown in an enlarged view in FIG. 2. The door tray 13 comprises a lateral wall 18, which runs in the peripheral direction about an axis A of the door tray 13, which is oriented in the height direction and thus in the y-direction. The lateral wall 18 comprises a first wall 20, which, in the embodiment shown, is a front wall, and a second wall 21, which is a side wall. The two walls 20 and 21 are not embodied to extend in the same plane, but are instead oriented at an angle in relation to one another, in particular 90°. To this end the ends of these two walls 20 and 21 which face one another open out at an arched transition 22, which is likewise an integral part of the lateral wall 18. The two walls 20 and 21 are planar. Viewed in the direction of axis A, the door tray 13 comprises an upper edge 19, which delimits a loading opening which runs around axis A.

Furthermore a single-piece decorative film 23 is embodied in an uninterruptible manner on the exteriors of the walls 20 and 21 and on the transition 22. Viewed in the direction of axis A the decorative film 23 extends only in areas across the walls 20 and 21 and also only in areas across the transition 22. In the embodiment shown, provision is made, viewed in the direction of axis A, for this decorative film 23 to be embodied starting from the upper edge 19 across a specific partial height of the walls 20 and 21 and across a specific partial height of the transition 22. As is apparent, the decorative film 23 is embodied as a horizontal strip. A lower edge 24 of the decorative film 23 which faces away from the upper edge 19 is embodied to be precise and chip-free. This lower edge 24 also runs so as to end on a stepless surface area 20*a* of the first wall, on a stepless surface area 21*a* of the second wall and on a stepless surface area 22*a* of the transition 22.

This means that viewed in the height direction and thus in the direction of axis A where the lower edge 24 is arranged, the walls 20 and 21 and also the transition 22 have no step which runs along this lower edge 24. Instead, the embodiment is such that those surface areas of the walls 20 and 21 and of the transition 22 which are covered by the decorative film 23, are flush with those surface areas of the walls 20 and 21 and also of the transition 22, which then adjoining thereto are no longer covered by the decorative film 23. The boundary between these said surface areas is therefore stepless or embodied so as to pass smoothly into one another.

As is apparent, the lower edge 24 runs horizontally and is also embodied to be opaque in the exemplary embodiment. In the exemplary embodiment the decorative film 23 is a hot stamping film, which is embodied with an individual, in particular a brushed, metallic appearance. In the exemplary embodiment this extends as a strip or as a decorative film 23 designed as a strip in the peripheral direction about the axis A across the entire length of the wall 20 measured in this peripheral direction A and also across the entire length of the wall 21 and also across the entire length or extent of the transition 22. Furthermore, in the embodiment shown a further wall which faces the wall 21 is also provided with a decorative film 23 in a corresponding area.

LIST OF REFERENCE CHARACTERS

1 Domestic refrigeration appliance
2 Body
3 Inner container
4 Receiving space
5 Receiving space
6 Door
7 Door
8 Compartment divider
9 Compartment divider
10 Compartment divider
11 Interior
12 Door element
13 Door tray
14 Door tray
15 Door tray
16 Drawer
17 Drawer
18 Lateral wall
19 Upper edge
20 Wall
20*a* Stepless transition
21 Wall
21*a* Stepless transition
22 Transition
22*a* Stepless transition
23 Decorative film
24 Lower edge
A Axis

The invention claimed is:

1. A domestic refrigeration appliance, comprising:

a tray-shaped food-accommodating container being a door tray or a drawer, said container including:

a lateral wall including a first planar wall, at least one second planar wall disposed at an angle to said first planar wall and a curved transition, said first and said at least one second planar walls opening out at said curved transition and being interconnected by said curved transition, said first planar wall, said at least one second planar wall and said transition each having a respective stepless surface area; and a hot stamping decorative film being formed in one piece and being disposed across said transition, on areas of said first wall and on areas of said at least one second wall, said decorative film having a lower edge facing away from an upper edge of the food-accommodating container, said lower edge of said decorative film being disposed on said stepless surface areas of said transition of said first wall and of said at least one second wall.

2. The domestic refrigeration appliance according to claim 1, wherein said lower edge of said decorative film is disposed to run horizontally.

3. The domestic refrigeration appliance according to claim 1, wherein said decorative film is a horizontal strip.

4. The domestic refrigeration appliance according to claim 1, wherein said decorative film is opaque.

5. The domestic refrigeration appliance according to claim 1, wherein said decorative film has a brushed, metallic appearance.

6. The domestic refrigeration appliance according to claim 1, wherein said lateral wall defines a circumferential direction, and said decorative film is a strip disposed in said circumferential direction about said lateral wall, extending completely across a length of said transition measured in said circumferential direction and a length of said first wall measured in said circumferential direction and a length of said at least one second wall measured in said circumferential direction.

7. The domestic refrigeration appliance according to claim 1, wherein said decorative film has an upper edge opening out at the upper edge of the food-accommodating container.

* * * * *